US005943700A

United States Patent [19]

Hammer et al.

[11] Patent Number: 5,943,700

[45] Date of Patent: Aug. 31, 1999

[54] WEIGHTED GARMENT

[76] Inventors: Coach Hammer, 962 Somerfor Pl., Creve Coeur; Janice Hawk; Thomas M. Hawk, both of 11161 Clayton Rd., Frontenac, all of Mo. 63131

[21] Appl. No.: 08/854,176

[22] Filed: May 9, 1997

[51] Int. Cl.[6] ..... A41D 1/04

[52] U.S. Cl. ..... 2/102; 2/94

[58] Field of Search ..... 2/102, 118, 119, 2/94, 95, 64

[56] References Cited

U.S. PATENT DOCUMENTS

| | | | |
|---|---|---|---|
| 2,696,617 | 12/1954 | Worcester | 2/102 |
| 3,261,042 | 7/1966 | Baker | 2/102 X |
| 3,529,307 | 9/1970 | Belson et al. | 2/94 |
| 4,268,917 | 5/1981 | Massey . | |
| 4,344,620 | 8/1982 | Debski | 2/102 X |
| 4,368,917 | 1/1983 | Massey | 2/94 X |
| 4,382,302 | 5/1983 | Watson | 2/102 |
| 4,602,387 | 7/1986 | Zakrzewski | 2/102 |
| 4,658,442 | 4/1987 | Tomlinson et al. | 2/102 X |
| 4,989,267 | 2/1991 | Watson | 2/102 |
| 5,002,270 | 3/1991 | Shine . | |
| 5,072,458 | 12/1991 | Suzuki | 2/102 |
| 5,120,288 | 6/1992 | Sinaki . | |
| 5,144,694 | 9/1992 | Conrad Da Oud et al. | 2/102 X |
| 5,211,163 | 5/1993 | Mortenson . | |
| 5,211,321 | 5/1993 | Rodriguez | 2/102 X |
| 5,617,582 | 4/1997 | Burwell | 2/102 |

OTHER PUBLICATIONS

Article "A l–y walking program and increased dietary calcium in postmenopausal women: effects on bone" American Society for Clinical Nutrition 1991.

Article "Estrogen Therapy and Variable Resistance Weight Training Increase Bone Mineral in Surgically Menopausal Women" Journal of Bone and Mineral Research—vol. 6, No. 6, 1993.

Article "The Prevention and Treatment of Osteoarthritis" The New England Journal of Medicine—Aug. 27, 1992.

Article Weight–Bearing Exercise Training and Lumbar Bone Mineral Content in Post Menopausal Women—Washington School of Medicine St. Louis, MO 1988.

Article Effects of High–Intesity Strength Training on Multiple Risk Factors for Osteoporotic Fractures—JAMA—Dec. 28, 1994.

Article Relationship of Body Composition, Muscle Strength, and Aerobic Capacity to Bone Mineral Density in Older Men and Women—Journal of Bone and Mineral Research—vol. 4, No. 3, 1989.

Article Hormone and Bone Mineral Status in Endurance-Trained and Sedentary Postmenopausal Women—Annual of Clinical Edocrinology and Metabolism, 1988.

*Primary Examiner*—John J. Calvert
*Assistant Examiner*—Shirra L. Jenkins
*Attorney, Agent, or Firm*—Paul M Derk

[57] ABSTRACT

A vest or garment is made of two independent halves which are removably connectable to each other. Each half has a body portion having an inner surface and an outer surface, and a shoulder loop extending up from the body to position the body portion of each half below an underarm of a person wearing the vest. At least one pocket is formed on the body portion to enable the vest to removably receive a weight. To connect the two halves together, so that the garment may be worn, an upper strap extends from the shoulder loop and a lower strap extending from the body portion. The upper straps are adapted to be connected to each other to extend across the person's back and the lower straps are adapted to be connected to each other to extend across the person's abdomen.

12 Claims, 2 Drawing Sheets

WEIGHTED GARMENT

STATEMENT REGARDING FEDERALLY SPONSORED RESEARCH OR DEVELOPMENT

Not Applicable.

CROSS-REFERENCE TO RELATED APPLICATIONS

Not Applicable

BACKGROUND OF THE INVENTION

This invention relates to weight loaded garments for use in increasing bone mineral density, and in particular, to a vest or jacket in which the amount of weight carried by the garment can be varied.

It is known that the bone mineral density of people, and women in particular, decreases with age. This leads to the onset of osteoporosis and an increased likelihood of bone fractures due to frail bones. It is also known that physical fitness, in the category of weight bearing resistance exercise, and the increased muscle mass associated with such physical fitness is closely related to bone mineral density. That is, the more one engages in such physical fitness, the greater the muscle density will be, and hence, the greater the bone mineral density will be. Bone mineral density is also correlated to body weight, and the greater the body weight, the greater the bone mass. This correlation between body weight and bone mineral density is referred to as Wolff's law, which provides that bone remodeling is directly dependent on the mechanical load placed on the bone.

As can be appreciated, those who have greater bone mineral density are at less of a risk of being osteoporitic and of incurring osteoporitic bone fractures. However, not all people are capable of engaging in exercises which will increase bone mass. And gaining weight to increase bond mineral density is not a healthy choice.

BRIEF SUMMARY OF THE INVENTION

One object of the present invention is to provide a weighted garment which will allow sedentary people to increase their bone mineral density during every day living, and without the need to partake in special exercises.

Another object is to provide such a garment in which the weight load of the garment can be altered to fit the needs of the individual wearing the garment.

Another object is to provide such a garment in which the weights are placed such that they have the maximal benefit.

Another object is to provide such a garment which is easy to put on and take off.

These and other objects will become apparent to those skilled in the art in light of the following disclosure and accompanying drawings.

Briefly stated, a vest or garment of the present invention is made of two independent halves which are removably connectable to each other. Each half has a body portion having an inner surface and an outer surface, and a shoulder loop extending up from the body to position the body portion of each half below an underarm of a person wearing the vest. At least one pocket is formed on the body portion to enable the vest to removably receive a weight. To connect the two halves together, so that the garment may, be worn, an upper strap extends from the shoulder loop and a lower strap extending from the body portion. The upper straps are adapted to be connected to each other to extend across the person's back and the lower straps are adapted to, be connected to each other to extend across the person's abdomen.

The upper straps extending from the back edges of the garment and the lower strap extending from the front edges of the garment. The upper strap connector comprises a hook and pile connector. The upper straps each have an inner surface and an outer surface. The upper strap of the first half has, for example, the hook portion mounted to its inner surface and the upper strap of the second half has the pile portion mounted to its outer surface. This will enable the straps to be connected together without being twisted. The use of the hook and pile connectors allows for the effective length of the upper straps to be altered so that the vest can be worn snugly and comfortably by a variety of sizes of people.

The lower strap has a fixed end connected to the body portion of the garment and a free end spaced from the fixed end. The lower strap connector comprises a buckle movable along the strap between the fixed and the free end of the strap, so that the effective length of the strap may be altered. Preferably, the buckle is a two piece buckle wherein one piece of the buckle is mounted to the lower strap of one of the first half and the second piece of the buckle is mounted to the lower strap of the other of the second half of the vest.

The vest halves are preferably made from an inner and outer layer of material. The inner layer has a bottom portion and the shoulder strap. The outer layer being connected to the inner layer bottom portion along a bottom and two sides to define a pocket. The outer layer is connected to the inner layer at at least one location intermediate the sides of the outer layer to define at least two pockets. The pockets, if more than one pocket is provided for each half, are of substantially the same size.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
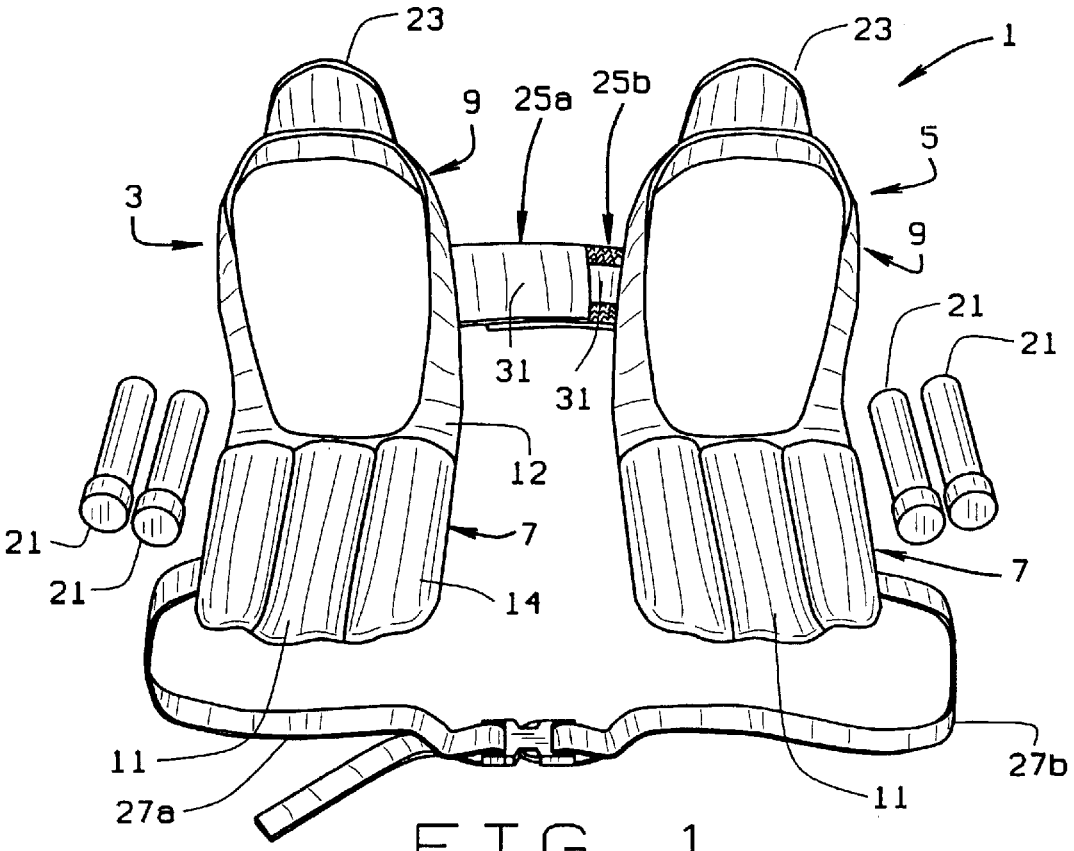
FIG. 1 is a plan view of the outer surfaces of a garment of the present invention with weights used in association with the garment.
Figure 2:
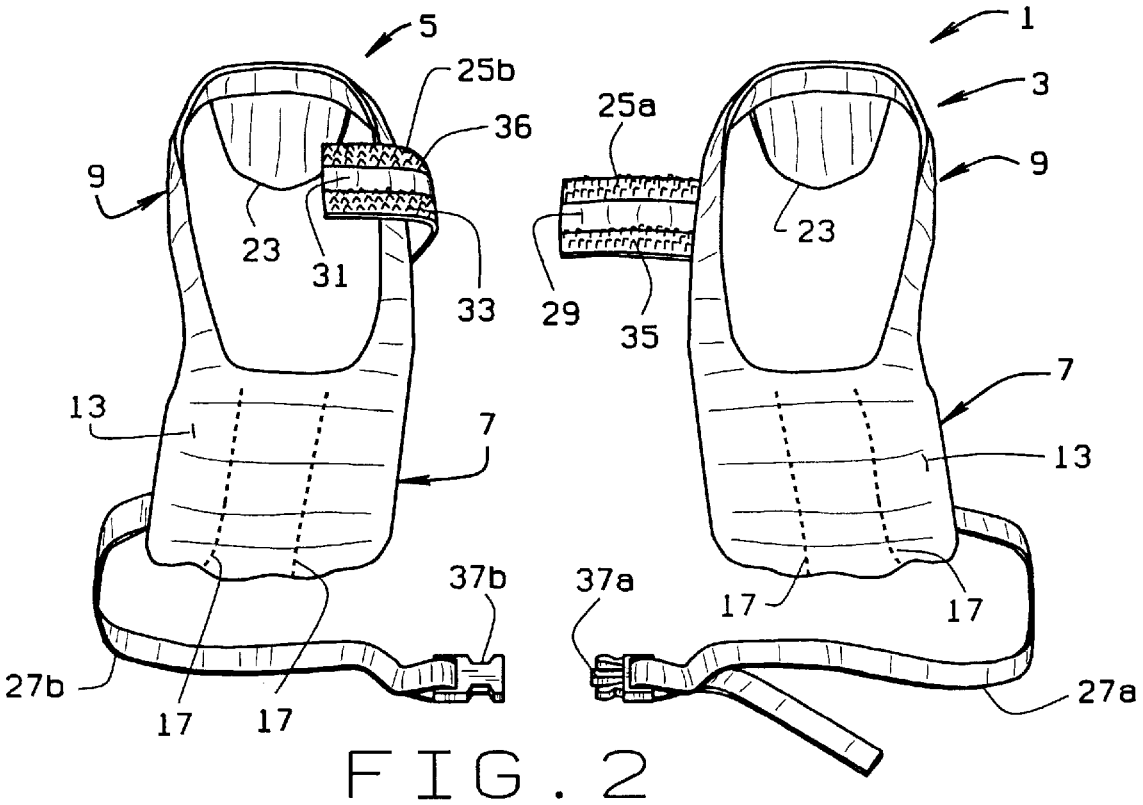
FIG. 2 is a plan view of the inner surfaces of the garment, the garment shown in a disconnected state.
Figure 4:
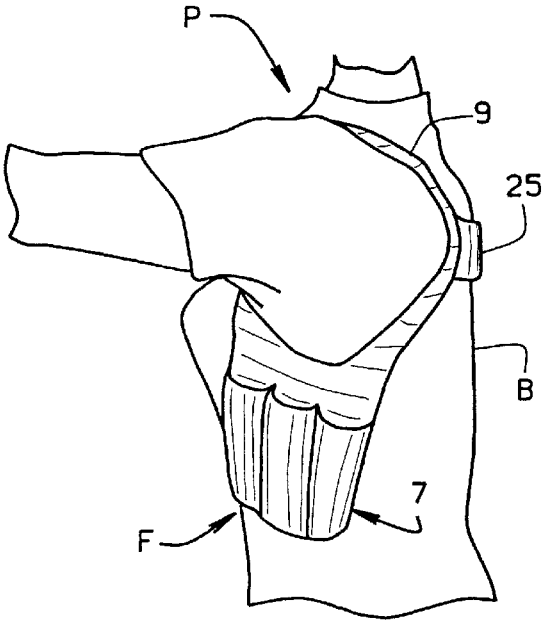
FIG. 4 is a side elevational view of a person wearing the garment.
Figure 5:
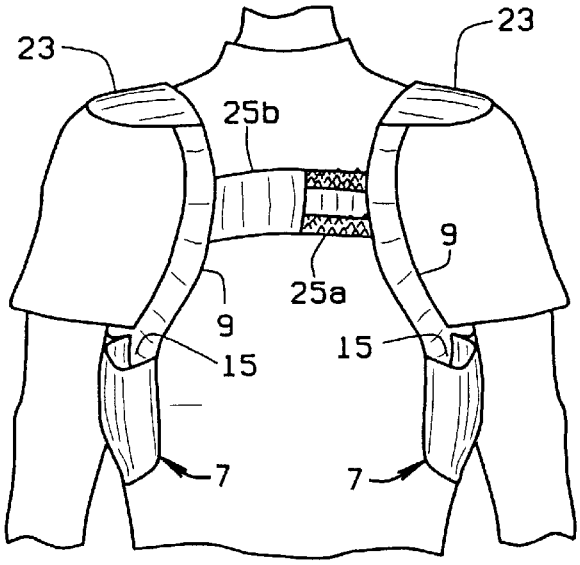
FIG. 5 is a back plan view of a person wearing the garment.

A vest 1 of the present invention is shown generally in FIGS. 1 and 2. The vest 1 includes a first half 3 and a second half 5 which are substantially identical. The halves 3 and 5 each include a body 7 and a shoulder strap 9. The bodies 7 each have a front edge, a back edge, an outer surface 11 and an inner surface 13. Preferably, the bodies 7 are formed of a fabric base layer 12 and a fabric top layer 14 which are joined together around the side and bottom edges of the top layer 14, but not along the top edges of the top layer 14. Pockets 15, best seen in FIGS. 4 and 5, are formed by providing rows of stitching 17 which connect the two layers 12 and 14 of fabric together between the sides of the top layer 14. As seen, preferably two rows of stitching 17 are provided to form three pockets 15. More or fewer pockets could be created, if desired. Similarly, the pockets could be formed in other ways, if desired. The pockets 15 are sized to removably accept weights 21 . Although two weights are shown for each half of the vest, obviously, each half can accept up to three weights.

The shoulder strap or loop 9 extends up from the body 7 and is preferably integral with the base layer 12 of fabric which forms the body 7. Thus, each half 3 and 5 of the vest 1 is essentially made of two pieces of material. The shoulder loops 9 include shoulder pads 23 at their tops. The shoulder pads preferably extend outwardly over the person's shoulder when the vest is worn.

As can be seen in the drawings, the two halves 3 and 5 of the vest 1 are independent of each other. They are thus provided with a pair of straps which allow the two halves of the vest to be connected. Vest half 3 includes an upper strap 25*a* and a lower strap 27*a* and vest half 5 includes an upper strap 25*b* and a lower strap 27*b*. The respective upper and lower straps 25*a,b* and 27*a,b* are removably connectable to each other. The upper straps 25*a,b* each have an inner surface 29 and an outer surface 31 and are provided with the mating halves of a loop and pile connecting system, such as a Velcro® connector. Thus, as shown, the outer surface 31 of the strap 25*a* has the hook portion 35 of the hook and pile connector and the inner surface 29 of strap 25*b* has the pile portion 36 of the hook and pile connector. Preferably, two generally parallel and spaced apart strips of hook and pile material are provided, however, a single strip could be provided if desired. The straps 25*a,b* are connected to the shoulder loops 9 approximately midway up the loops 9 and along the back edge of the vest halves 3 and 5 so that they span across the back B of the person P wearing the vest 1, as seen in FIG. 5. Preferably, the straps 25*a,b* extend across the back just below the shoulder blades of the wearer. However, the exact location of the straps 25*a,b* on the wearer ultimately depends on the length of the loops 9 and the size of the person P.

Figure 3:
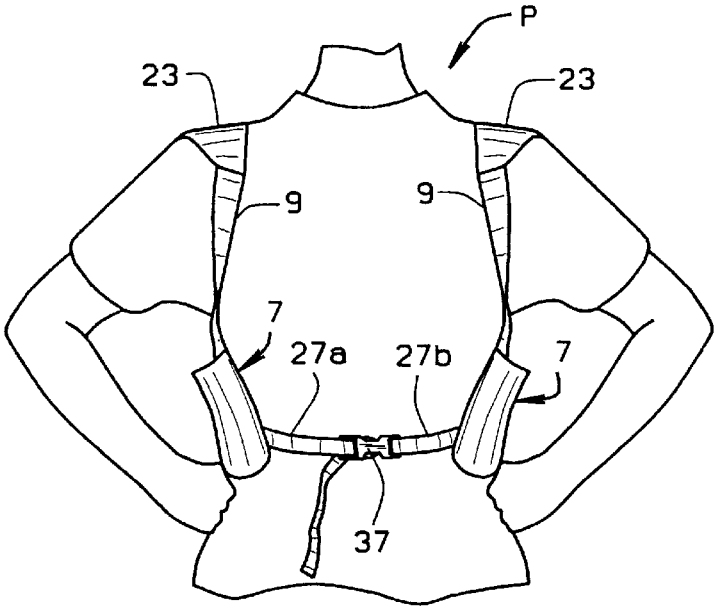
FIG. 3 is a front plan view of a person wearing the garment.

The straps 27*a,b* are connected at their fixed ends to the body 7 of the vest halves 3 and 5 near the bottom of the body 7 and along a front edge of the body 7. When connected, they extend across the front F of the person P (preferably at the person's waist), as best seen in FIG. 3. The straps 27*a,b* are preferably provided with a buckle 37 which will allow for adjustment of the straps 27*a,b* on the wearer so that people of various sizes can wear the vest 1. As shown in the drawings, the buckle 37 has two pieces 37*a,* which are matingly and removably connectable to each other. As shown, buckle piece 37*a* is mounted to strap 27*a* so that its position on the strap may be altered as desired by the person wearing the vest, so that the effective length of strap 27*a* may be altered. The buckle piece 37*b* is fixed to the free end of the strap 27*b*. Although a two piece buckle is shown, any type of buckle could be used. Preferably, the buckle used will allow for alteration in the effective lengths of at least one of the straps 27*a,b* and may allow for alteration of the effective length of both of the straps 27*a,b*. Other types of connecting systems could be used in place of the buckle. For example, the straps 27*a,b* could also be provided with hook and pile connectors or even snaps to enable the two straps to be connected together. Other types of connecting systems could also be used. For example, although not necessarily preferred, the two straps could simply be tied together.

The vest is easy to don and remove. Initially, the back straps 25*a,b* are connected together to connect the two halves 3 and 5. The wearer then slides his or her arms through the loop holes and then connects the lower straps 27*a,b* along the front of the wearer. As noted, the vest halves are made of fabric. Therefore, they are fairly flexible, and the vest should be easy to put on by almost anybody. If a wearer does not have sufficient arm movement to place his or her arms through the loops 9 when the halves 3 and 5 are connected, the two halves 3 and 5 of the vest 1 can be independently put on and then another person could connect the upper back straps 25*a,b* for the wearer.

As noted, three pockets 15 are provided. Weights 21 may be placed in any or all of the pockets. The weight of the vest can therefore be varied, depending on the size and number of the weights placed in the vest pockets 15. The weights can, for example, be five pound weights. Thus, each vest half could be provided with five, ten, or fifteen pounds of weight. The loops 9 are sized such that the pockets 15 and the weights 21 will be located on the wearer's side and underneath the wearer's armpits, as best seen in FIG. 4.

When the wearer or person P wears the vest 1 with weights 21 in the pockets 15, the person's body will think it has increased body mass. Therefore, through simply wearing the vest 1 during everyday activities, and without any special exercises, the wearer P will be able to increase his or her bone mineral density.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

We claim:

1. A vest having a first half and a second half, said fast and second halves being independent of each of other and removably connectable to each other, each said half having:

a body portion having an inner layer and an outer layer;

said outer layer substantially covering said inner layer;

said outer layer being connected to said inner layer to define at least one pocket on said body portion, said at least one pocket being adapted to removably receive a weight;

a shoulder loop extending up from said body portion inner layer to position said body portion of each said half below an underarm of a person wearing the vest;

each pocket of a body portion being positioned on the vest to be directly beneath an armpit of the user, and provided for receiving a weight therein;

an upper strap extending from said shoulder loop, said upper strap comprising a first part extending from said vest first half and a second part extending from said vest second half said strap first and second parts being adapted to be removably corrected to each other, said upper strap when connected extending across the back of the wearer;

a lower strap extending from each said body portion, said lower strap comprising a first part extending from said vest first half and a second part extending from said vest second half, said strap first and second parts being adapted to be removably connected to each other;

each vest half has a front edge and a back edge, the upper strap parts extending from one of said front and back edges and the lower strap parts extending from the other of said front and back edges, said lower strap when connected extending across the front of the wearer; and the, upper strap fist and second parts being held together by a connector, said connector comprises a hook and pile connector, the upper strap parts each having an inner surface and an outer surface, the first part of the upper strap having one of the hook and pile portions of the connector on its inner surface, the second part of the upper strap having the other of the hook and pile portion of the connector on its outer surface.

2. The garment of claim 1 wherein each part of the lower strap has a fixed end connected to the body portion of the garment and a free end spaced from the fixed end, each free end of the lower strap being held together by a connector, the lower strap connector comprising a buckle movable along the at least one of the lower strap pats between the fixed and the free end of the lower strap part.

3. The garment of claim 2 wherein the buckle is a two piece buckle wherein one piece of the buckle is mounted to one of the first and second parts of the lower strap and the second piece of the buckle is mounted to the other of the first and second parts of the lower strap.

4. The garment of claim 1 including a shoulder pad adhered to a top portion of said shoulder loop.

5. The garment of claim 4 wherein said shoulder pad extends outwardly over the person's shoulder when the vest is worn.

6. The garment of claim 1 having two or more pockets; said pockets being adjacent each other and separated by a line of connection of the outer layer to the inner layer.

7. A garment capable of removably receiving a selected amount of weight, sad garment comprising a first half and a second half, said first and second halves being independent of each other and removably connectable to each other, each said half of said vest including an inner layer and an outer layer, said inner layer having a bottom portion and a shoulder strap portion, said outer layer being connected to said inner layer bottom portion along a bottom and two sides to define a pocket, said pocket being positioned on the vest to be directly beneath an armpit of the user;

each pocket being adapted to removably receive a weight therein to provide for an increase in the wearer's bone mineral density through the wearing of said weighted garment;

each half of said garment having a front edge and a back edge, said garment further including a first pair of straps extending from said back edges of said halves and a second pair of straps extending from said front edges of said halves, said first pair of straps being removably connectable together to connect said garment halves together directly around the upper back of a wearer, and said second pair of straps being removably connectable directly together to connect said garment halves together across the lower front of the wearer.

8. The garment of claim 7 wherein said outer layer is connected to said inner layer at at least one location intermediate the sides of said outer layer to define at least two pockets.

9. The garment of claim 8 wherein the at least two pockets of each half are of substantially the same size.

10. The garment of claim 7 wherein the effective length of said straps of said first and second pair of straps are alterable.

11. The garment of claim 10 wherein the first pair of straps is provided with hook and pile connectors to removably connect the first pair of straps together.

12. The garment of claim 10 wherein the second pair of straps is provided with a buckle to removably connect the second pair of straps together.

* * * * *

UNITED STATES PATENT AND TRADEMARK OFFICE

CERTIFICATE OF CORRECTION

PATENT NO. : 5,943,700

DATED : August 31, 1999

INVENTOR(S) : Hammer, et al.

It is certified that error appears in the above-indentified patent and that said Letters Patent is hereby corrected as shown below:

Claim 1, line 1, change "fast" to ---first---.

Claim 1, line 20, change "corrected to ---connected---.

Claim 2, line 6, change "pats" to ---parts---.

Claim 7, line 2, change "sad" to ---said---.

Signed and Sealed this

Sixth Day of June, 2000

*Attest:*

Q. TODD DICKINSON

*Attesting Officer*

*Director of Patents and Trademarks*